US008579674B2

(12) United States Patent
Carlson et al.

(10) Patent No.: US 8,579,674 B2
(45) Date of Patent: Nov. 12, 2013

(54) MOBILE TOY WITH DISPLACEABLE FLYWHEEL

(75) Inventors: Gabriel Carlson, Los Angeles, CA (US); Michael Bernstein, Hermosa Beach, CA (US); Dominic Laurienzo, Los Angeles, CA (US); Dion Fields, Thousand Oaks, CA (US)

(73) Assignee: JAKKS Pacific, Inc., Malibu, CA (US)

( * ) Notice: Subject to any disclaimer, the term of this patent is extended or adjusted under 35 U.S.C. 154(b) by 368 days.

(21) Appl. No.: 12/587,625

(22) Filed: Oct. 10, 2009

(65) Prior Publication Data

US 2010/0093256 A1 Apr. 15, 2010

Related U.S. Application Data

(60) Provisional application No. 61/195,812, filed on Oct. 10, 2008.

(51) Int. Cl.
*A63H 29/02* (2006.01)
*A63H 29/22* (2006.01)

(52) U.S. Cl.
USPC ..... 446/462; 446/94; 446/95; 446/466; 446/469; 446/470; 446/429

(58) Field of Classification Search
CPC ..... A63H 29/02; A63H 29/22; A63H 17/00
USPC ..... 446/429–430, 269, 93–96, 233, 431, 446/457, 448–449, 465–471, 462, 463; 280/43, 43.11, 64, 78
IPC ..... A63H 17/00
See application file for complete search history.

(56) References Cited

U.S. PATENT DOCUMENTS 663,506 A * 12/1900 Loree ..... 446/462
693,375 A * 2/1902 Clark ..... 446/462
837,040 A * 11/1906 Clark ..... 446/462
944,096 A 12/1909 Kirkby (Continued)

FOREIGN PATENT DOCUMENTS

JP 2006-314440 A * 11/2006

OTHER PUBLICATIONS

Yasunaga, Nov. 2006, JP2006-314440 A, Machine Translation, 1-17.*

(Continued)

*Primary Examiner* — Gene Kim
*Assistant Examiner* — Matthew B Stanczak
(74) *Attorney, Agent, or Firm* — Tope-McKay & Associates

(57) ABSTRACT

A mobile toy which is propelled by a flywheel is described. The mobile toy includes a body member having a set of protrusions which extend beyond the body member. An axle extending through the flywheel is positioned in the set of protrusions, such that each protrusion operates as an axle cap. Alternatively, a set of axle caps are formed at the end of the axle. The flywheel is formed as a displaceable flywheel which is repositionable or removable from the body member. The flywheel may be adjusted within the mobile toy at multiple positions relative to the mobile toy for use of the mobile toy on multiple types of surfaces and for various play configurations. A set of detachably attachable extension elements attached with the axle caps alter the appearance as well as the play capabilities of the mobile toy.

16 Claims, 12 Drawing Sheets

(56) References Cited

U.S. PATENT DOCUMENTS

| | | | | | |
|---|---|---|---|---|---|
| 1,098,895 | A | | 6/1914 | Edgar | |
| 1,495,911 | A | | 5/1923 | Lemoine | |
| 1,584,979 | A | | 5/1926 | Clausen | |
| 2,124,302 | A | * | 7/1938 | Loh et al. | 446/436 |
| 2,148,374 | A | | 2/1939 | Hogan | |
| 2,195,083 | A | | 3/1940 | Einfalt | |
| 2,625,831 | A | * | 1/1953 | Saunders, Jr. | 74/342 |
| 2,677,216 | A | * | 5/1954 | Hein | 446/462 |
| 2,736,132 | A | | 2/1956 | Murray | |
| 3,318,600 | A | | 5/1967 | Glass et al. | |
| 3,603,032 | A | | 9/1971 | Heron | |
| 3,621,607 | A | * | 11/1971 | Morrison | 446/279 |
| 3,650,067 | A | * | 3/1972 | Greenwood | 446/233 |
| 3,703,048 | A | | 11/1972 | Cooper | |
| 3,789,540 | A | * | 2/1974 | Convertine et al. | 446/180 |
| 3,816,958 | A | * | 6/1974 | Winston | 446/462 |
| 3,826,039 | A | * | 7/1974 | Disko et al. | 446/271 |
| 2,932,957 | A | | 1/1976 | Morrison et al. | |
| 3,984,939 | A | | 10/1976 | Wolgamot et al. | |
| 4,059,918 | A | | 11/1977 | Matsushiro | |
| 4,156,986 | A | * | 6/1979 | Kupperman et al. | 446/462 |
| RE30,299 | E | | 6/1980 | Greenwood | |
| 4,300,308 | A | | 11/1981 | Ikeda | |
| 4,324,063 | A | * | 4/1982 | Rosenwinkel et al. | 446/202 |
| 4,373,290 | A | * | 2/1983 | Goldfarb et al. | 446/202 |
| 4,443,967 | A | * | 4/1984 | Jones et al. | 446/462 |
| 4,475,305 | A | | 10/1984 | Kawakami et al. | |
| 4,498,886 | A | * | 2/1985 | Goldfarb et al. | 446/202 |
| 4,536,168 | A | | 8/1985 | Stephens | |
| 4,556,397 | A | | 12/1985 | Arad et al. | |
| 4,593,618 | A | * | 6/1986 | Lebensfeld | 101/375 |
| 4,631,041 | A | | 12/1986 | Chang et al. | |
| 4,655,725 | A | | 4/1987 | Torres | |
| 4,685,894 | A | | 8/1987 | Beny et al. | |
| 4,772,241 | A | | 9/1988 | Bro et al. | |
| 4,892,503 | A | | 1/1990 | Kumazawa | |
| 4,982,961 | A | | 1/1991 | Ichimura | |
| 5,087,219 | A | | 2/1992 | Price | |
| 5,823,545 | A | * | 10/1998 | Goeckel | 280/11.231 |
| 5,823,845 | A | | 10/1998 | O'Berrigan | |
| 5,823,848 | A | * | 10/1998 | Cummings | 446/429 |
| 5,916,008 | A | * | 6/1999 | Wong | 446/445 |
| 5,957,745 | A | | 9/1999 | Johnson et al. | |
| 6,071,173 | A | * | 6/2000 | Kelley | 446/465 |
| D431,611 | S | * | 10/2000 | Dilabio et al. | D21/533 |
| 6,280,286 | B1 | | 8/2001 | Andrews | |
| 6,676,476 | B1 | | 1/2004 | Lund et al. | |
| 6,682,394 | B2 | | 1/2004 | Tilbor et al. | |
| 6,764,374 | B2 | | 7/2004 | Tilbor et al. | |
| 6,786,796 | B2 | | 9/2004 | Suto | |
| 6,988,929 | B2 | * | 1/2006 | Wong | 446/462 |
| 7,329,167 | B2 | | 2/2008 | Nagasaka et al. | |
| 7,445,539 | B2 | | 11/2008 | Laurienzo et al. | |
| 2005/0181703 | A1 | | 8/2005 | Kuralt | |
| 2006/0211333 | A1 | * | 9/2006 | Laurienzo | 446/465 |
| 2006/0292962 | A1 | | 12/2006 | Takeyasu et al. | |
| 2007/0207699 | A1 | | 9/2007 | Hoeting et al. | |

OTHER PUBLICATIONS

Office Action for U.S. Appl. No. 12/660,238, dated Feb. 28, 2011.
Office Action Response for U.S. Appl. No. 12/660,238, dated May 27, 2011.
Office Action for U.S. Appl. No. 12/660,238, dated Jun. 29, 2011.
Office Action Response for U.S. Appl. No. 12/660,238, dated Sep. 29, 2011.
Office Action for U.S. Appl. No. 12/660,238, dated Nov. 9, 2011.
Office Action Response for U.S. Appl. No. 12/660,238, dated Jan. 17, 2012.
Office Action for U.S. Appl. No. 12/660,238, dated May 7, 2012.
Office Action Response for U.S. Appl. No. 12/660,238, dated Aug. 7, 2012.

* cited by examiner

MOBILE TOY WITH DISPLACEABLE FLYWHEEL

PRIORITY CLAIM

The present application is a Non-Provisional patent application of U.S. Provisional Application No. 61/195,812, filed in the United States on Oct. 10, 2008, titled, "Mobile Toy with Removable Flywheel."

BACKGROUND OF THE INVENTION (1) Field of Invention

The present invention relates to a mobile toy and, more particularly, to a mobile toy which is influenced by a repositionable or replaceable flywheel.

(2) Description of Related Art

Toy vehicles which are propelled by flywheels have long been known in the art. Conventionally, toy vehicles are designed to include a gear train to transmit rotation of a permanently affixed flywheel to the drive axles of other wheels. Since the flywheel is not removable or repositionable, the toy vehicle is limited to one type of movement as well as one type of surface for propelling the toy vehicle.

Thus, a continuing need exists for a mobile toy with a repositionable or replaceable flywheel to allow the mobile toy to perform various stunts, to be utilized on various play surfaces, and to easily change the appearance and function of the mobile toy.

SUMMARY OF INVENTION

The present invention relates to mobile toy with a displaceable flywheel. The mobile toy includes a body member with a displaceable flywheel attachable thereto.

In another aspect, the displaceable flywheel has a rotational axis, and the body member is formed such that the displaceable flywheel is repositionable with respect to the body member. Repositioning the displaceable flywheel within the body member alters the rotational axis of the displaceable flywheel with respect to the body member.

In another aspect, the displaceable flywheel is removable from the body member, such that the displaceable flywheel may be replaced with another displaceable flywheel.

In another aspect, the body member comprises a front portion, a rear portion, and a perimeter bounded by the front portion and the rear portion. The body member further comprises a set of protrusions extending beyond the perimeter, such that the protrusions are approximately aligned with the rotational axis of the displaceable flywheel.

In another aspect, the present invention further comprises an axle having a first end and a second end extending through the displaceable flywheel, wherein the axle is positioned in the set of protrusions, such that each protrusion operates as an axle cap.

In yet another aspect, the present invention further comprises detachably attachable extension elements for detachable attachment with the axle caps.

In another aspect, the body member further comprises a top portion and a bottom portion, wherein the top portion is connectable with the bottom portion, and wherein the displaceable flywheel is positionable between the top portion and the bottom portion.

In another aspect, the displaceable flywheel is repositionable within the body member at different ride heights.

In another aspect, a central axis extends from the front portion to the rear portion, wherein the displaceable flywheel is repositionable within the body member at different angles such that the repositioning of the displaceable flywheel alters an angle between the central axis and the rotational axis of the displaceable flywheel.

Additionally, the present invention comprises a mobile toy with a flywheel comprising a body member having a flywheel attached therewith. The body member comprises a front portion, a rear portion, and a perimeter bounded by the front portion and the rear portion, wherein the body member further comprises a set of protrusions extending beyond the perimeter, such that the protrusions are approximately aligned with a rotational axis of the flywheel.

Finally, as can be appreciated by one in the art, the present invention also comprises a method for forming the mobile toy with displaceable flywheel described herein. The method for forming the device includes a plurality of acts of forming, attaching, connecting, etc., each of the described components to arrive at the present invention.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1:
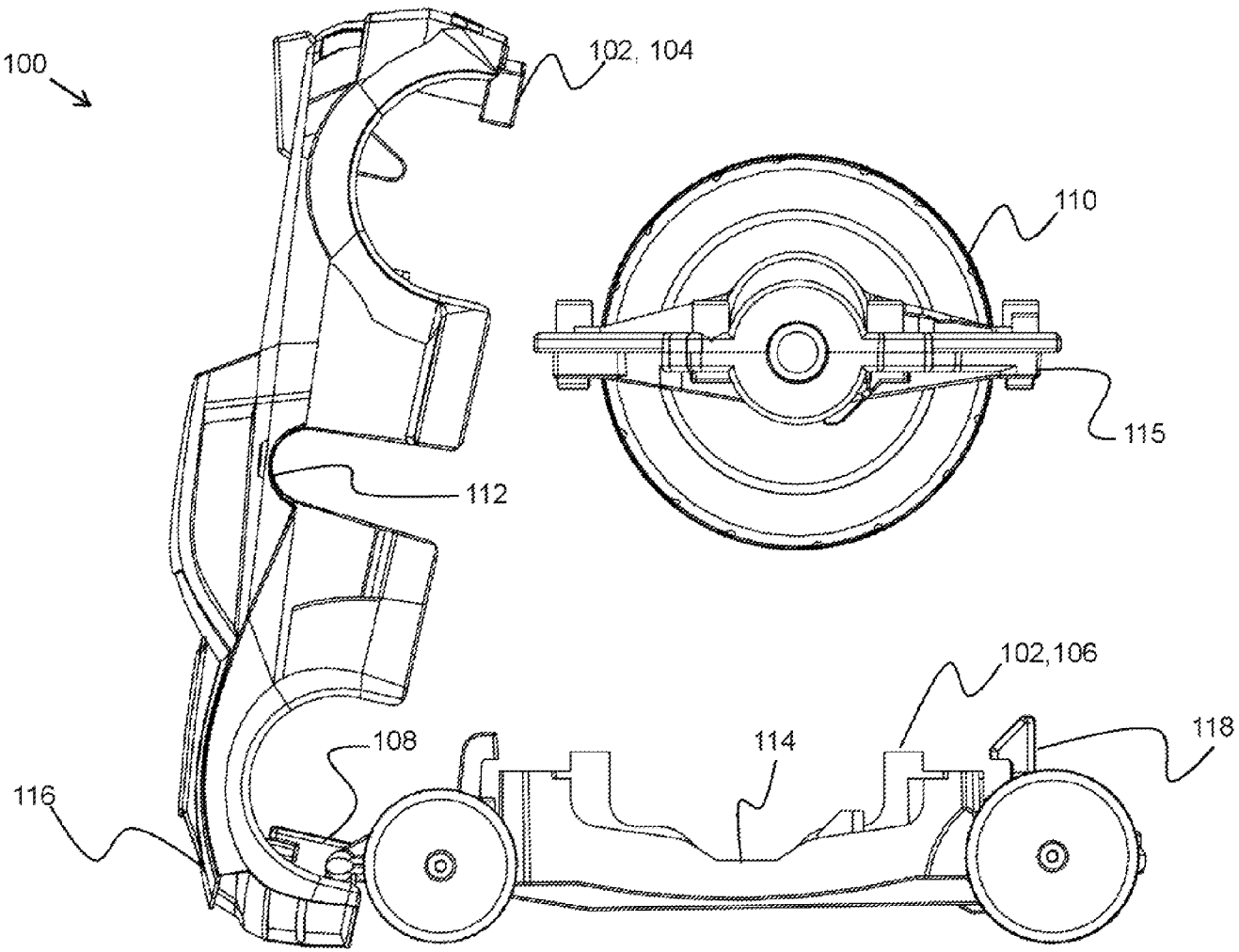
FIG. 1 illustrates a side-view of a mobile toy with a displaceable flywheel showing the body member in an opened configuration and the displaceable flywheel removed according to the present invention.

The present invention relates to a mobile toy and, more particularly, to a mobile toy which is influenced by a repositionable or replaceable flywheel. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

The present invention relates to a mobile toy having a displaceable flywheel. The flywheel may be removable from the mobile toy and/or repositionable within the toy, as will be described in further detail below. In a desired aspect, the mobile toy is a toy vehicle. Non-limiting examples of a toy vehicle include a toy car, plane, train, space ship, skateboard, motorcycle, bicycle, and tricycle. Furthermore, the mobile toy may be rollerblades, roller skates, shoes, or a toy figure/character.

FIG. 1 illustrates a side-view of a mobile toy 100, shown as a toy car, depicting a body member 102 which includes a top portion 104 and a bottom portion 106 (or chassis) arranged in a clamshell style. In a desired aspect, the mobile toy 100 is a 1/64 scale miniature toy vehicle; however, all scales of toy vehicles are possible. The body member 102 may be comprised of any durable and lightweight material, non-limiting examples of which include plastic and metal. In one aspect, the top portion 104 and the bottom portion 106 of the body member 102 are connected by at least one point by a connector 108 to allow the top portion 104 to pivot away from the bottom portion 106, converting the body member 102 to an opened configuration as shown in FIG. 1. The connector 108 may be a hinge or any suitable connector which would allow the top portion 104 to pivot away from the bottom portion 106. Alternatively, the top portion 104 may be completely removable from the bottom portion 106 and may be detachably attached through a snap-fit mechanism, for example. This characteristic provides a user with the ability to interchange body styles for the mobile toy 100. Furthermore, the body member 102 may comprise multiple hinged and/or snap-fit fixtures to form the mobile toy 100.

Opening (or removal) of the top portion 104 of the body member 102 away from the bottom portion 106 of the body member 102 provides access to a weighted displaceable flywheel 110 for its placement in or removal from the bottom portion 106 of the mobile toy 100. The unique configuration of the body member 102 allows a user to easily remove the flywheel 110 from the mobile toy 100 and replace it with a flywheel 110 of a different style to provide a new play experience. Additionally, the configuration of the body member 102 provides the capability of easily repositioning the flywheel 110 within the body member 102. In one aspect, the mobile toy 100 includes a sub-chassis 115 which is formed to fit into the bottom portion 106 of the mobile toy 100, as shown. The flywheel 110 is positioned in the sub-chassis 115, which is then placed in the bottom portion 106. Furthermore, the body member 102 comprises a front portion 116, a rear portion 118, and a perimeter bounded by the front portion 116 and the rear portion 118.

In one aspect, the bottom portion 106 further comprises at least one notch 114 on both sides to receive the flywheel 110 and/or sub-chassis 115. Additionally, the top portion 104 comprises at least one corresponding notch 112 on both sides of the top portion 104, which is aligned with the notch 114 of the bottom portion 106, to provide space for a portion of the flywheel 110 and/or sub-chassis 115 when the mobile toy 100 is in a closed configuration. In a desired aspect, the inclusion of multiple aligned notches 112 and 114 in the top portion 104 and bottom portion 106 allows for multiple adjustments of the flywheel 110 at different positions in the mobile toy 100.

In another aspect, the mobile toy 100 comprises multiple lock configurations which lock the portions of the body member 102 and/or the flywheel 110 in place. As a non-limiting example, at least one snap-fit fixture secures the flywheel 110 into its proper place on the bottom portion 106. Therefore, additional fasteners and tools are not required for a user to access the flywheel 110.

As described above, the inclusion of multiple notches 114 along the bottom portion 106 of the mobile toy 100 allows for variable placement of the flywheel 110 to allow a user to easily reposition they flywheel 110 in the mobile toy. The flywheel 110 may be shifted to multiple positions within the mobile toy (e.g., forward/backward, right/left, up/down) and/or positioned at various angles. The displaceable flywheel 110 has a rotational axis, and, in one aspect, the body member 102 is formed such that the flywheel 110 is repositionable with respect to the body member 102. Repositioning the flywheel 110 within the body member 102, therefore, alters the rotational axis of the flywheel 110 with respect to the body member 102. The flywheel 110 can be arranged at different positions, up and down, so that the mobile toy 100 has variable ride heights. Furthermore, a central axis extends from the front portion 116 to the rear portion 118 of the body member 102, and the flywheel 110 is repositionable within the body member 102 at different angles. Repositioning of the flywheel 110 alters an angle between the central axis and the rotational axis of the flywheel 110. The flywheel 110 may also be arranged at various positions along the length of the mobile toy 100 (e.g., front and back) in addition to up and down or angled.

Figure 2:
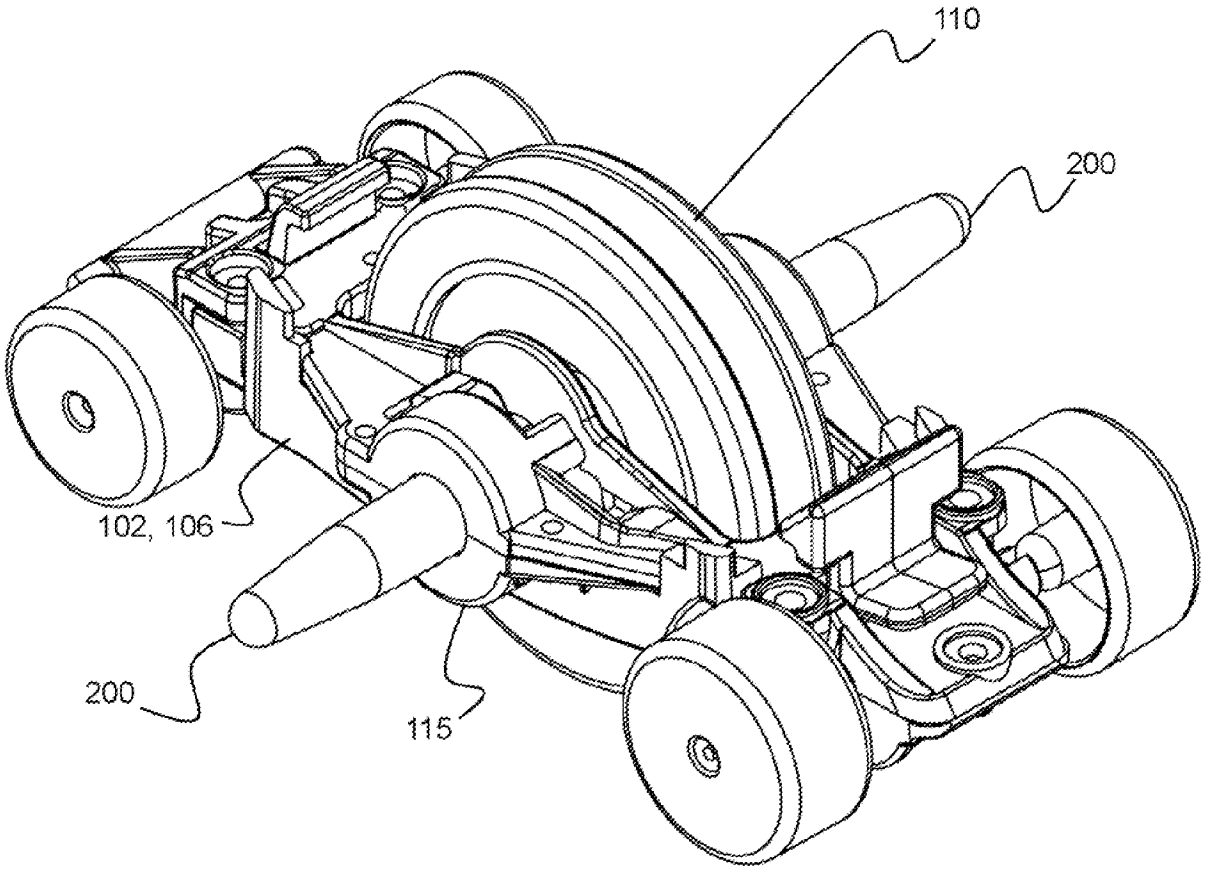
FIG. 2 illustrates a perspective-view of a bottom portion of the body member with the displaceable flywheel positioned therein according to the present invention.

FIG. 2 illustrates a perspective-view of the flywheel 110 and sub-chassis 115, positioned within the bottom portion 106. The flywheel 110 includes an opening (or hub) to allow an axle, to be inserted through the opening. The axle may be comprised of any suitable material, non-limiting examples of which include plastic and metal. The axle extends through the opening of the flywheel 110 to both sides of the flywheel 110. In one aspect, the body member 102 further comprises a set of protrusions extending beyond the perimeter bounded by the front and rear portions of the body member 102. The protrusions are approximately aligned with the rotational axis of the displaceable flywheel 110. In this aspect, the axle is positioned in the set of protrusions, such that each protrusion operates as an axle cap. In another aspect, and as depicted in FIG. 2, each end of the axle is surrounded or covered by an axle cap 200. The axle cap 200 may be molded to each end of the axle or attached with the axle by any suitable mechanism, such as a snap-fit mechanism. As described above, notches in the bottom portion 106 allow for placement of the sub-chassis 115 and flywheel 110 into the bottom portion 106. Corresponding notches in the top portion provide clearance for the axle caps 200.

In a desired aspect, each axle cap 200 extends beyond the body member 102 of the mobile toy. The axle caps 200 allow the mobile toy to perform various stunts and tricks, such as spanning gaps between two strings or balancing on a side. Other unique stunts which may be performed by the mobile toy are barrel rolls and top spins. Additionally, the mobile toy may ride on rails of a track using the axle caps 200. The axle caps 200 may be formed in various shapes, a non-limiting example of which includes hook-shaped axle caps. Depending on the size and shape of the axle caps 200, the mobile toy may be guided along a number of surfaces, non-limiting examples of which include a standard track, custom track, or wire. The axle caps 200 may remain stationary as the flywheel 110 rotates or rotate along with the flywheel 110. In an additional aspect, the axle caps 200 may be formed as gears to engage a geared track to climb or traverse a section of the track. Alternatively, the axle caps 200 may be magnetic so that the axle caps 200 attract a track also having magnetic elements. Additionally, the axle caps 200 may be formed to accept snap-on/detachably attachable extension elements, non-limiting examples of which include clip-on hooks, pipes, hands, loops, engines, gears, or other accessories to provide a variety of play experiences.

Figure 3:
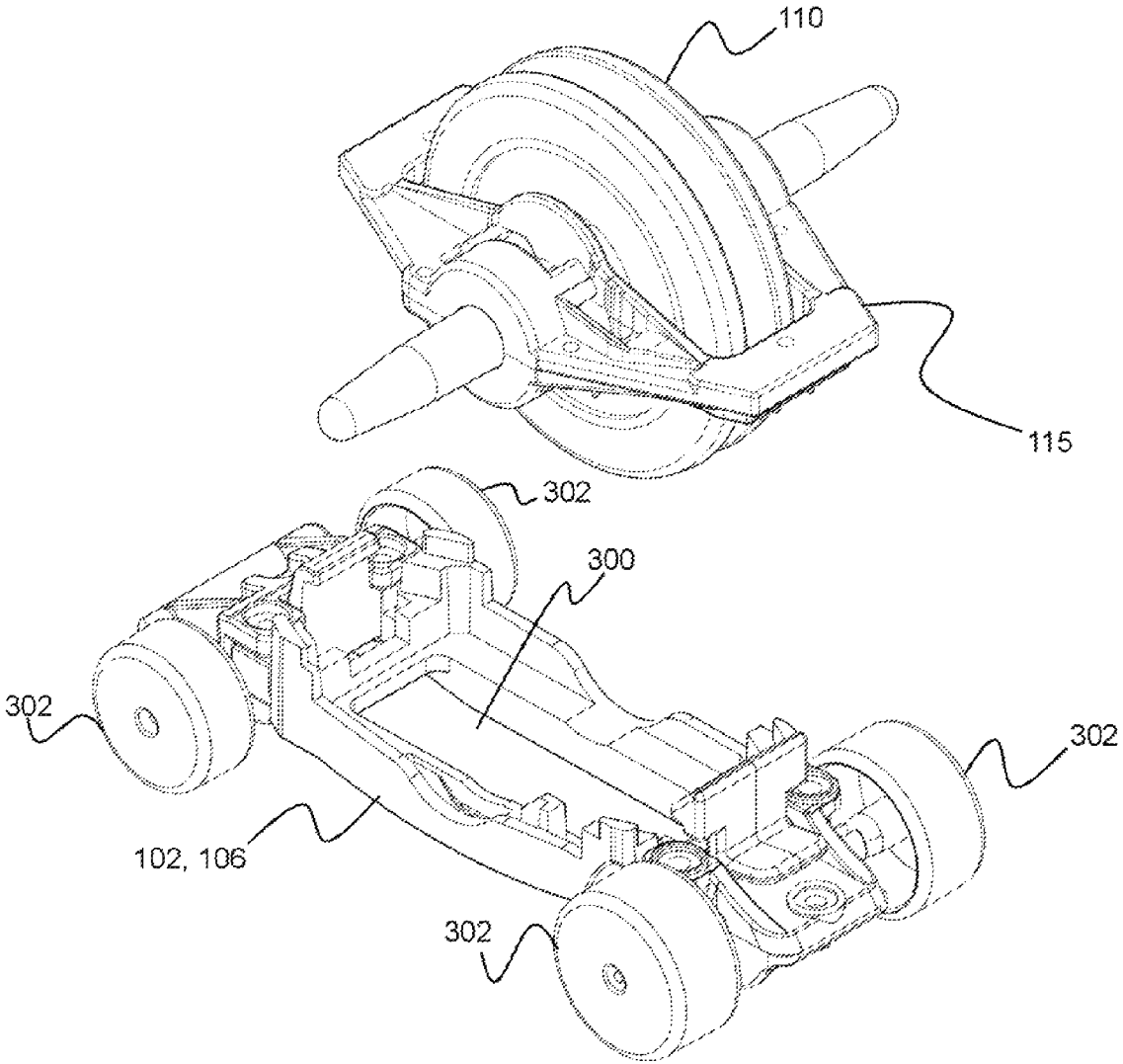
FIG. 3 illustrates a perspective-view of a bottom portion of the body member with the displaceable flywheel removed from the body member according to the present invention.

FIG. 3 illustrates the bottom portion 106 of the body member 102, shown with the sub-chassis 115 and attached flywheel 110 removed from the body member 102. In a desired aspect, the bottom portion 106 comprises an aperture 300 which allows at least a portion of the flywheel 110 to extend through the bottom portion 106. Additionally, the top portion (not shown) may include an aperture aligned with the aperture 300 in the bottom portion 106 so that at least a portion of the flywheel extends through the aperture in the top portion when the mobile toy is in a closed configuration. Alternatively, the top portion may comprise a cover (or may be a continuous material) over the portion of the flywheel 110 which extends through the top portion. The portion of the flywheel 110 which extends through the aperture 300 of the bottom portion 106 is able to contact a surface below the mobile toy to propel the mobile toy.

In one aspect, the mobile toy includes at least one vehicle wheel 302. As a non-limiting example and as shown in FIG. 3, the mobile toy includes four smaller vehicle wheels 302. In a desired aspect, the vehicle wheels 302 are configured to rotate. However, as can be appreciated by one skilled in the art, the vehicle wheels 302 may alternatively be fixed, such that only the flywheel 110 rotates. In another aspect, the vehicle wheels 302 may be smooth skids built into the chassis. The flywheel 110 comprises a die-cast wheel and an interchangeable tire comprised of any suitable material, such as rubber, to allow a user to easily change the tread style of the tire. As can be appreciated by one skilled in the art, the flywheel 110 may be comprised of any suitable material which allows the flywheel 110 to perform its intended function. Non-limiting examples of tread styles for the tire include rain slick, off-road, and motorcycle.

Figure 4:
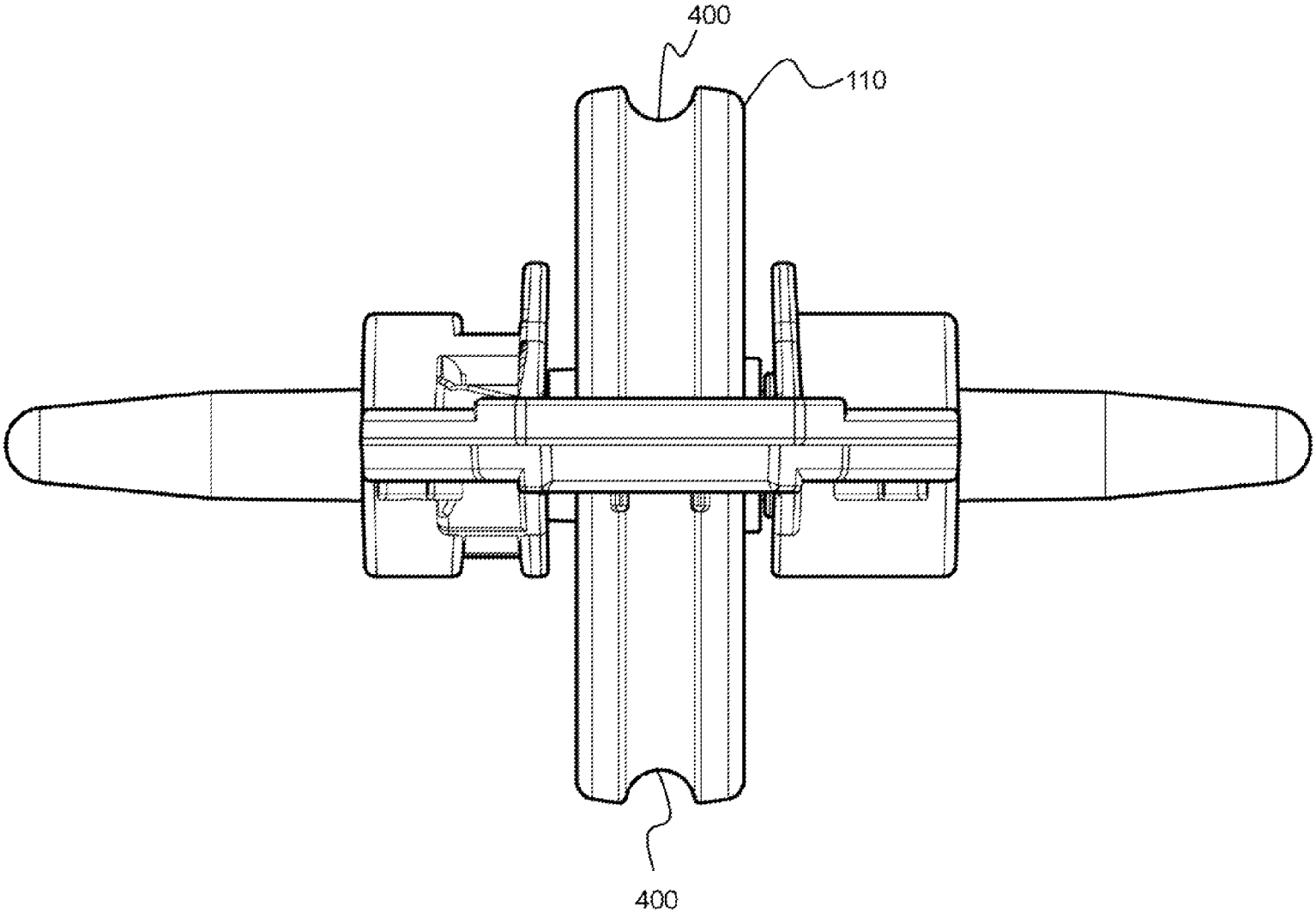
FIG. 4 illustrates a front-view of the displaceable flywheel and attached sub-chassis according to the present invention.

In another aspect, and as shown in FIG. 4, the flywheel 110 includes grooves 400 along its rim to allow placement of various interchangeable O-rings. The O-rings may include a variety of sizes, shapes, and textures to change the overall appearance of the flywheel 110. The grooves 400 may also allow placement of interchangeable tread styles. Alternatively, the grooves 400 can be used so that the flywheel 110 can grip and roll along a wire (or string or thin rail), with the wire passing through the groove 400 as the flywheel 110 rotates and carries the vehicle along the wire. Furthermore, the flywheel 110 may be molded in shapes other than a simple circle and/or may be molded so that its weight distribution is not even. Finally, as can be appreciated by one skilled in the art, instead of a flywheel 110, a weighted object may be placed in the mobile toy to provide the mobile toy with a rotating mass to generate and maintain forward momentum.

Figure 5B:
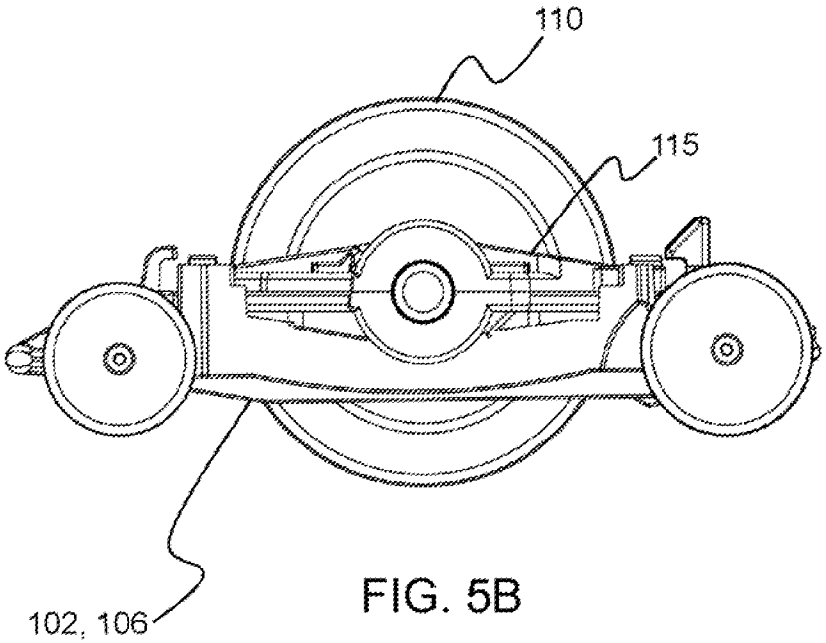
FIGS. 5A and 5B illustrate side-views of the bottom portion of the body member depicting high and low ride heights, respectively, according to the present invention.
Figure 5A:
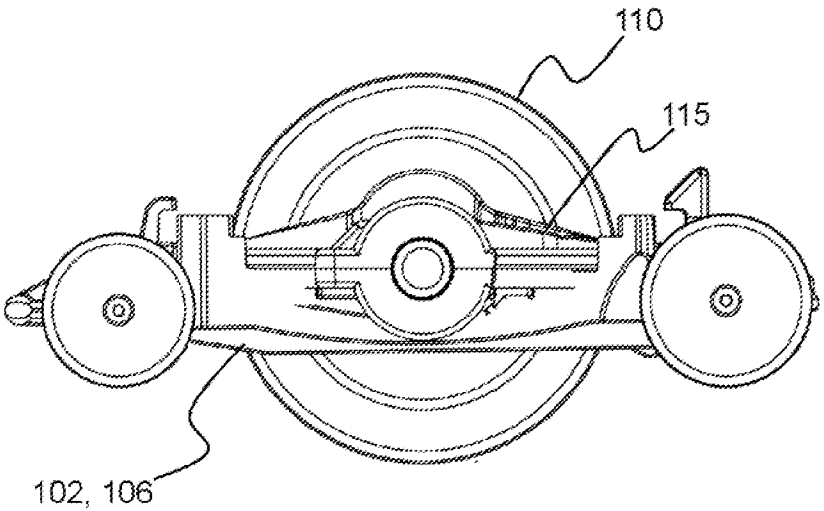
Figure 6B:
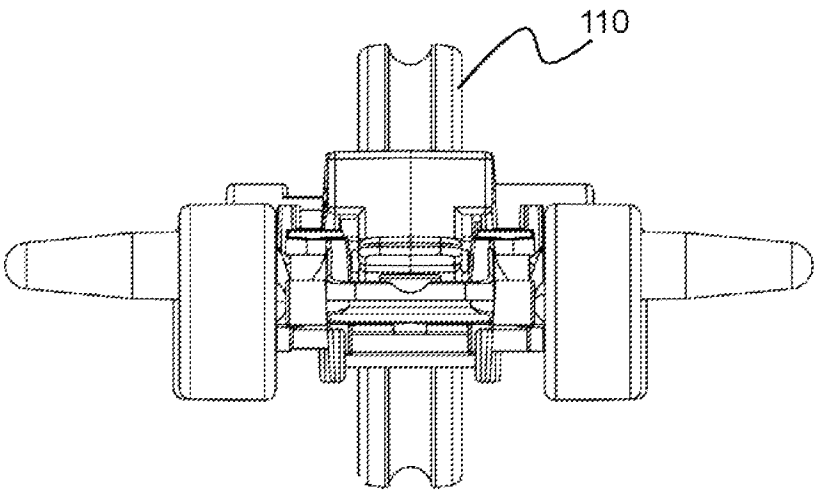
FIGS. 6A and 6B illustrate front-views of the bottom portion of the body member depicting low and high ride heights, respectively, according to the present invention.
Figure 6A:
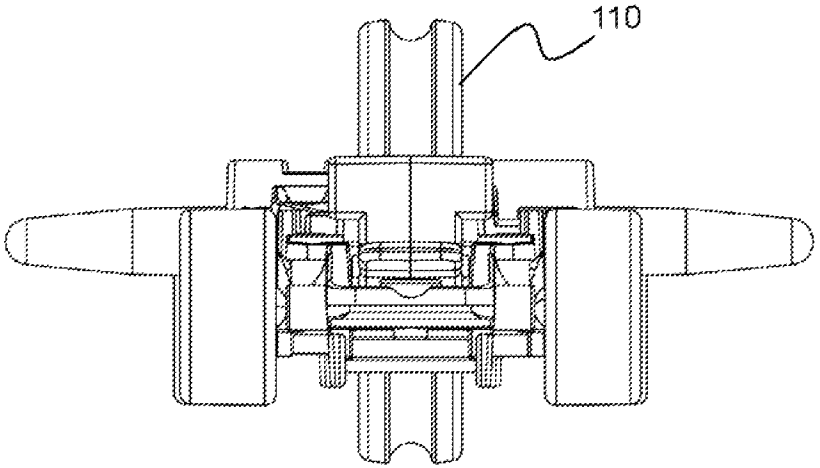

FIGS. 5A and 5B illustrate side-views of the flywheel 110 positioned in the bottom portion 106 of the body member 102 at a high-ground clearance (high ride height) and low-ground clearance (low ride height), respectively. In order to change the height of the flywheel 110, the flywheel 110 can be rotated 180 degrees so that the flywheel 110 is positioned higher (as shown in FIG. 5A) or lower (as shown in FIG. 5B) in the bottom portion 106 of the body member 102. The flywheel 110 is offset inside the sub-chassis 115, such that by flipping the sub-chassis 115 over (and attached flywheel 110) and reinserting it in the opposite orientation, the height ride of the mobile toy is altered. The low-ground clearance position of the flywheel 110, as shown in FIG. 5B, may be favored when the mobile toy is running a track or smooth surface. The high-ground clearance position of the flywheel 110, as shown in FIG. 5A, provides more ground clearance to allow the mobile toy to run on carpet, outdoor surfaces, uneven surfaces, small obstacles, and loops and jumps of a playset. FIGS. 6A and 6B depict front-view illustrations of the flywheel 110 positioned at a low ride height and a high ride height, respectively.

Figure 7:
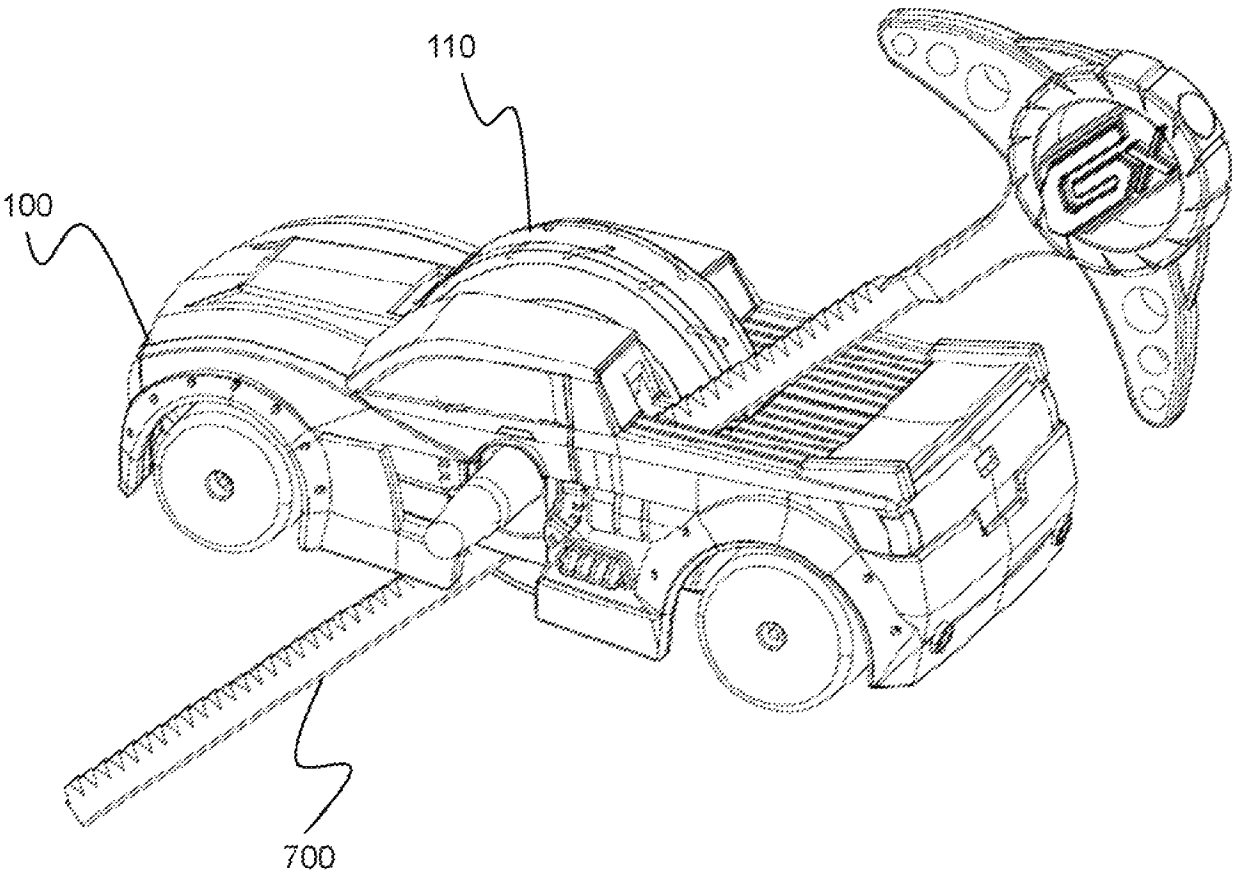
FIG. 7 illustrates a perspective-view of a mobile toy with an inserted ripcord according to the present invention.
Figure 8:
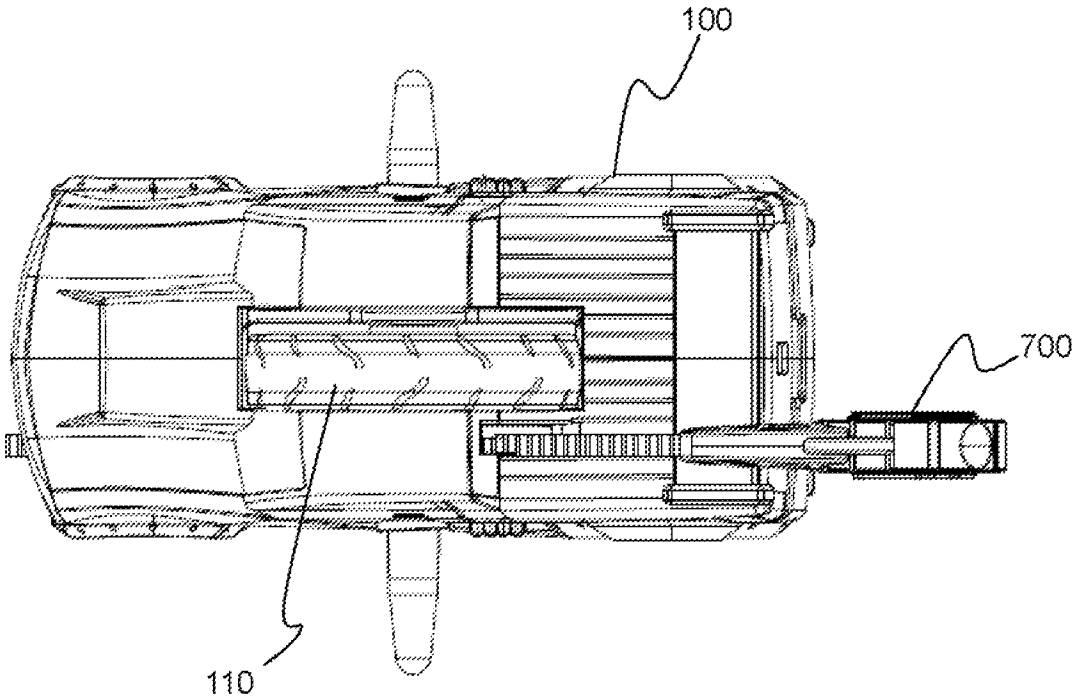
FIG. 8 illustrates a top-view of a mobile toy with an inserted ripcord according to the present invention.

In a desired aspect, and as shown in FIG. 7, the present invention further comprises a ripcord 700 which is removably insertable inside the mobile toy 100 and is configured to induce rotation of the flywheel 110. The ripcord 700 induces rotation of the flywheel 110 by interlocking with at least a portion of the flywheel 110 or axle. In an additional aspect, the mobile toy 100 is configured to be used in a launch holder. When a user pulls the ripcord 700 while the mobile toy 100 is in a launch holder, the flywheel 700 lifts off of a surface allowing it to spin freely. When the ripcord 700 is fully withdrawn, the mobile toy 100 falls down to the surface allowing the flywheel 110 to gain traction. The mobile toy 100 then accelerates under its own power. In a desired aspect, the ripcord 700 is inserted into the mobile toy 100 at a location in the mobile toy 100 that does not interfere with the flywheel 110 as shown in the top-view of the mobile toy 100 in FIG. 8. As can be appreciated by one skilled in the art, the ripcord 700 may power the mobile toy 100 without the use of a launch holder. Additionally, the mobile toy 100 may be powered either by a ripcord 700 or a similar device which performs the same function. Finally, a motorized or manual launcher may be utilized to propel the mobile toy 100.

Figure 9:
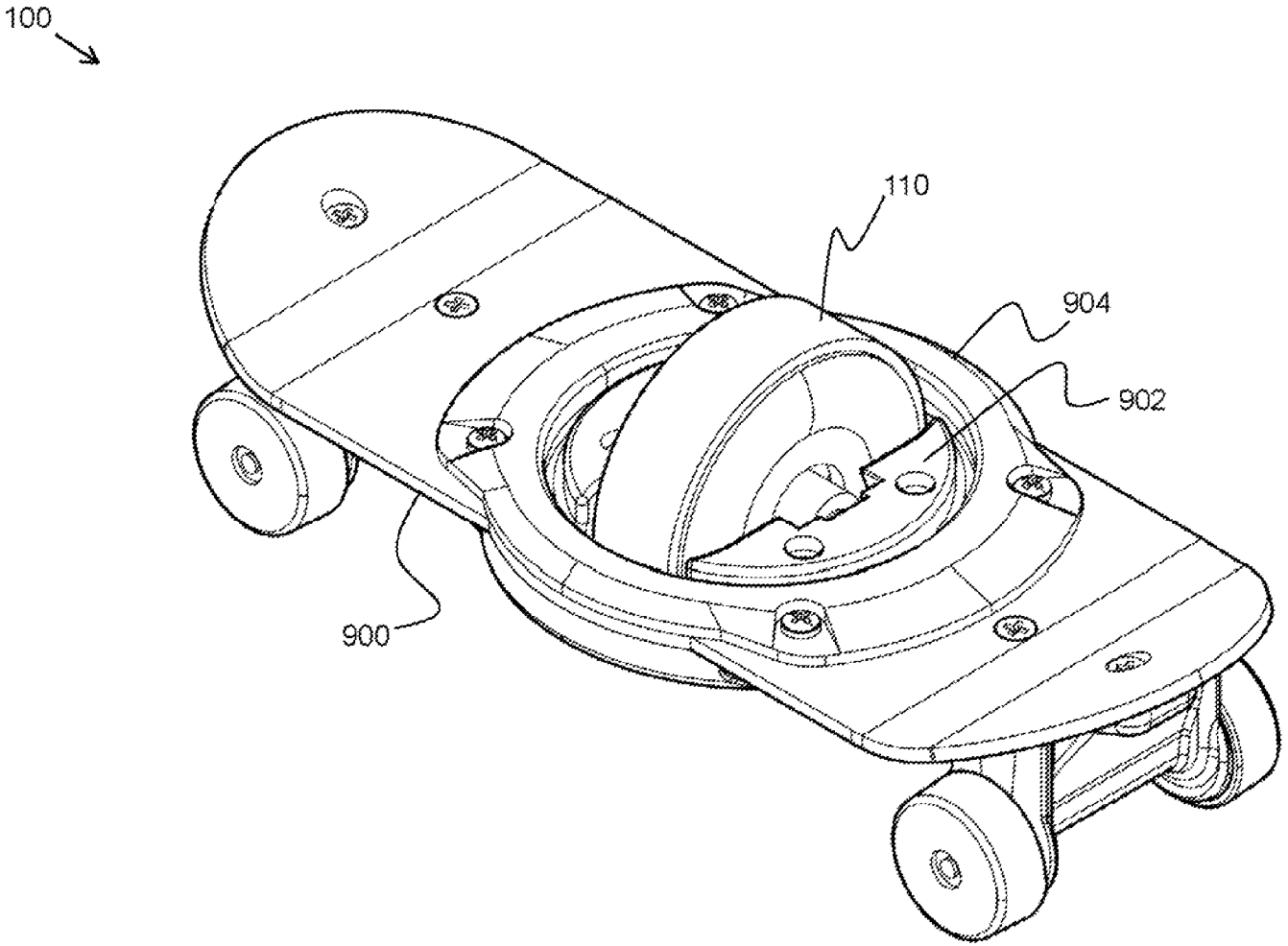
FIG. 9 illustrates a perspective-view of a mobile toy with a displaceable flywheel depicted as a skateboard according to the present invention.
Figure 10A:
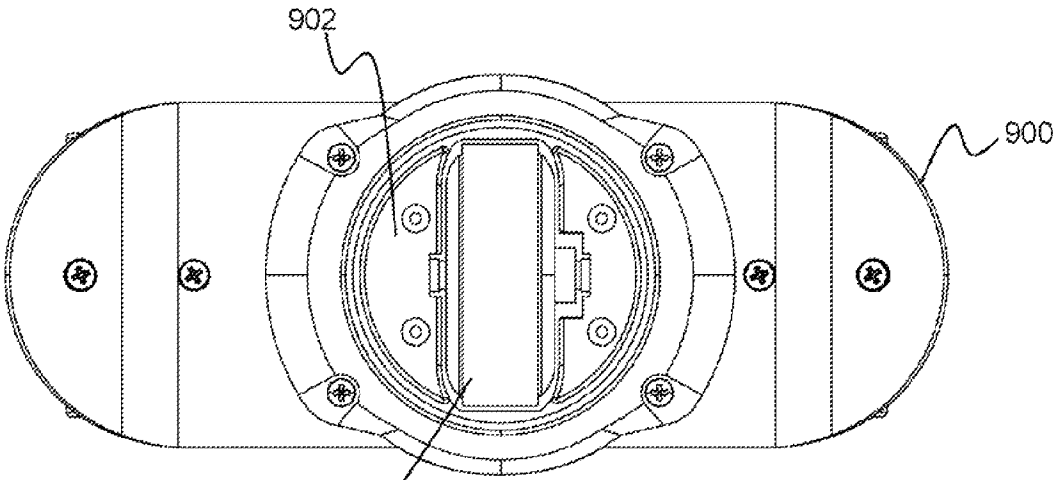
FIGS. 10A and 10B illustrate top-views of a mobile toy with a displaceable flywheel showing the displaceable flywheel in a first and second position, respectively, according to the present invention.
Figure 10B:
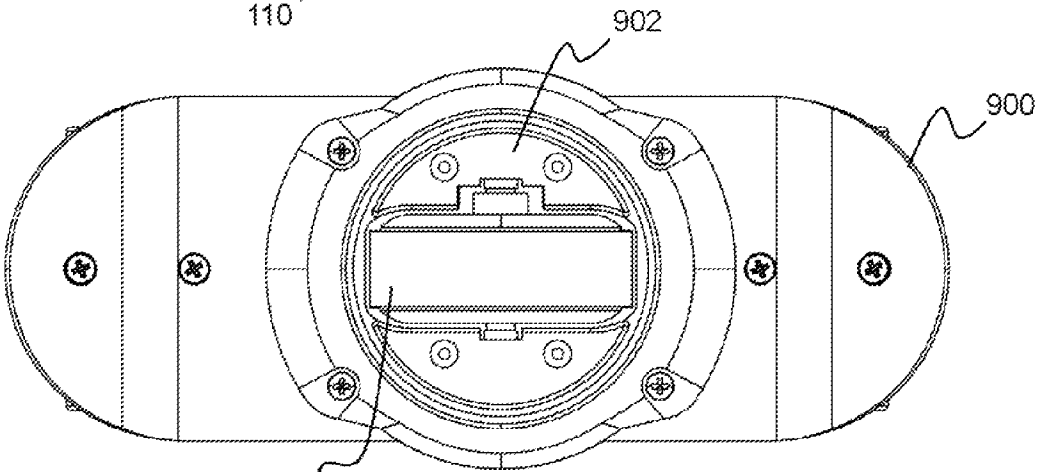

While the mobile toy 100 has been described as a toy vehicle, the present invention may alternatively be formed as a skateboard 900 as depicted in FIG. 9. As described above for the toy vehicle, the skateboard 900 also includes a displaceable flywheel 110 which is positioned within a sub-chassis 902 and can be displaced within or removed from a body member 904 of the skateboard 900. FIGS. 10A and 10B illustrate a top-view of the skateboard 900 showing a first and second position of the flywheel 110, respectively. The sub-chassis 902 and flywheel 110 can be rotated 90 degrees within the body member 904 by the user for various play effects. Additionally, the flywheel 110 may be removed from the body member 904 to easily interchange multiple flywheel 110 styles.

Figure 11:
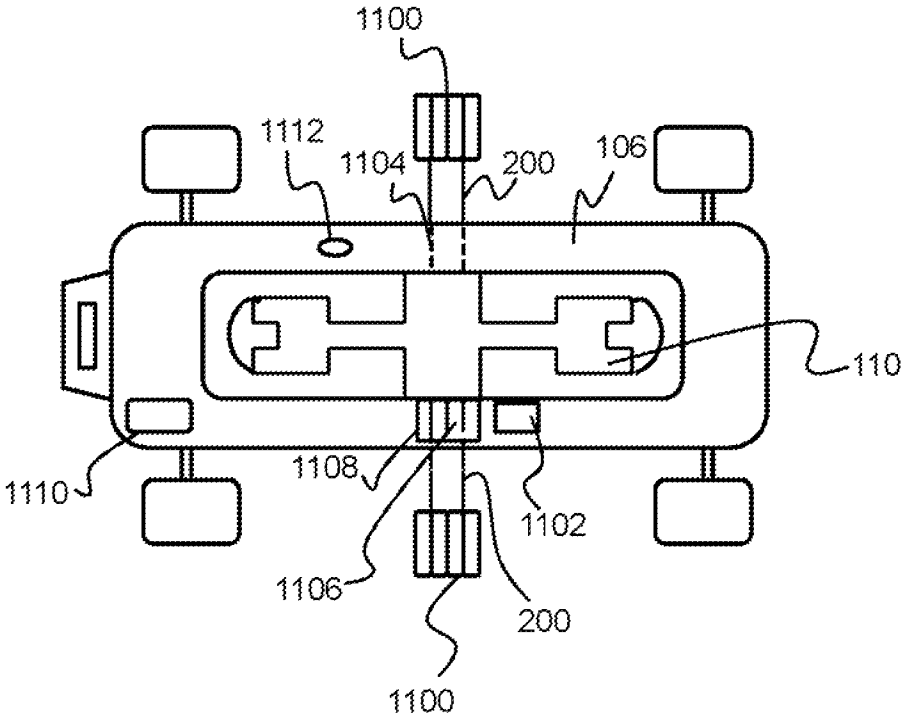
FIG. 11 illustrates a top-view of a bottom portion of a mobile toy with a displaceable flywheel according to the present invention.

FIG. 11 illustrates a top-view of the bottom portion 106 (or chassis) with the flywheel 110 positioned therein. In the aspect shown, the axle caps 200 comprise detachably attachable extension elements, a non-limiting example of which includes gears 1100, to impact the performance of the mobile toy. For instance, the gears 1100 attached with the axle caps 200 can engage a geared track for climbing or traversing a portion of the track. FIG. 11 also illustrates a ripcord slot 1102 within the bottom portion 106 for insertion and removal of the ripcord. As described above, the ripcord induces rotation of the flywheel 110 by interlocking with at least a portion of the flywheel 110 or axle 1104, as shown in FIG. 11. In the aspect shown, a portion of the axle 1104 includes an interlocking surface 1106, similar to gear teeth, which engages with the ripcord. Additionally, a viewing window 1108 may be formed in the bottom portion 106 so that a user can view the interlocking surface 1106 of the axle 1104.

In one aspect, a sound generating mechanism 1110 is connected with the bottom portion 106 (or another portion of the mobile toy) to produce a sound when the mobile toy is in motion or when at least one of the wheels rotates. In a desired aspect, one of the wheels produces a sound by providing resistance as the wheel turns. As a non-limiting example, the sound may be similar to the sound of a playing card hitting a bicycle spoke.

Additionally, a light generating mechanism 1112, such as a light emitting diode (LED) can be connected with the bottom portion 106 (or another portion of the mobile toy), which lights up when the mobile toy is in motion. In one aspect, electricity can be generated from the flywheel through a magneto mechanism, wherein permanent magnets produce pulses of high voltage alternating current. In this aspect, at least one magnet is connected with the flywheel and a coil of wire is connected with a portion of the mobile toy, such that the magnet is rotated as the flywheel rotates while the coil remains stationary.

Figure 12:
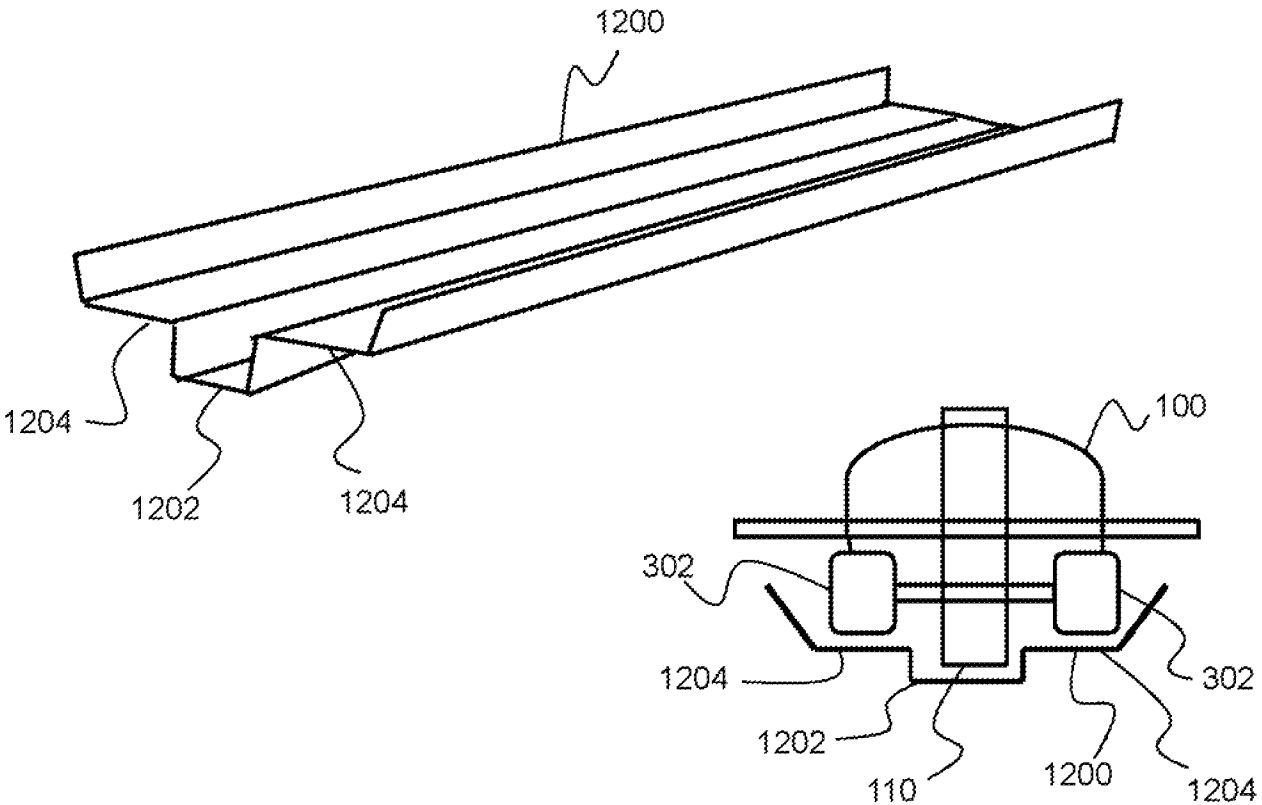
FIG. 12 illustrates a slotted track for use with a mobile toy with a displaceable flywheel according to the present invention.

As can be appreciated by one skilled in the art, the invention described herein can interact with a variety of play surfaces. As shown in FIG. 12, a non-limiting example of a play surface includes a slotted track 1200 having a groove 1202 in the center of the track 1200 and ledges 1204 on either side of the groove 1202. In use, the vehicle wheels 502 of the mobile toy 100 ride on the ledges 1204 on either side of the groove 1202 allowing the flywheel 110 to be positioned in the center groove 1202 of the track 1200. The groove 1202 is sized to provide clearance for the flywheel 110 to spin freely and retain its energy for later application.

What is claimed is:

1. A toy car with a displaceable flywheel, comprising:

a body member of a toy car with a displaceable flywheel attachable thereto, the body member having a top portion, a bottom portion, a front portion, a rear portion, and two side portions connecting the front portion and the rear portion;

two pairs of vehicle wheels connected with the body member, wherein a first pair of vehicle wheels is positioned along a first side portion and a second pair of vehicle wheels is positioned along a second side portion;

wherein the displaceable flywheel is positioned between the front portion and the rear portion;

an axle having a first end and a second end extending through the displaceable flywheel, wherein each end of the axle is surrounded by an axle cap that extends beyond each pair of vehicle wheels;

wherein the displaceable flywheel is formed to be invertible within the body member, such that inverting the displaceable flywheel alters a height of the displaceable flywheel within the toy car, thereby altering a ride height of the toy car;

wherein the displaceable flywheel protrudes beyond the top portion and the bottom portion of the body member.

2. The toy car as set forth in claim 1, wherein the displaceable flywheel has a rotational axis and where the body member is formed such that the displaceable flywheel is repositionable with respect to the body member, such that repositioning the displaceable flywheel within the body member alters the rotational axis of the displaceable flywheel with respect to the body member.

3. The toy car as set forth in claim 2, wherein the displaceable flywheel is removable from the body member, such that the displaceable flywheel may be replaced with another displaceable flywheel.

4. The toy car as set forth in claim 3, wherein the body member further comprises at least one set of notches formed opposite to one another in the two side portions, and wherein the set of notches are approximately aligned with the rotational axis of the displaceable flywheel.

5. The toy car as set forth in claim 4, wherein the axle is positioned in the at least one set of notches.

6. The toy car as set forth in claim 5, further comprising a detachably attachable extension element for detachable attachment with each axle cap.

7. The toy car as set forth in claim 6, wherein the top portion is connectable with the bottom portion, and wherein the displaceable flywheel is positionable between the top portion and the bottom portion.

8. The toy car as set forth in claim 7, wherein a central axis extends from the front portion to the rear portion, and wherein the displaceable flywheel is repositionable within the body member at different angles, such that repositioning the displaceable flywheel alters an angle between the central axis and the rotational axis of the displaceable flywheel.

9. A method for forming a toy car with a displaceable flywheel, comprising acts of:

forming a body member of a toy car with a displaceable flywheel attachable thereto, the body member having a top portion, a bottom portion, a front portion, a rear portion, and two side portions connecting the front portion and the rear portion;

forming two pairs of vehicle wheels connected with the body member, wherein a first pair of vehicle wheels is positioned along a first side portion and a second pair of vehicle wheels is positioned along a second side portion;

wherein the displaceable flywheel is positioned between the front portion and the rear portion;

forming an axle having a first end and a second end to extend through the displaceable flywheel, wherein each axle is surrounded by an axle cap that extends beyond each pair of vehicle wheels;

wherein the displaceable flywheel is formed to be invertible within the body member, such that inverting the displaceable flywheel alters a height of the displaceable flywheel within the toy car, thereby altering a ride height of the toy car; and wherein the displaceable flywheel is formed to protrude beyond the top portion and the bottom portion of the body member.

10. The method for forming a toy car as set forth in claim 9, wherein the displaceable flywheel is formed to have a rotational axis and where the body member is formed such that the displaceable flywheel is repositionable with respect to the body member, such that repositioning the displaceable flywheel within the body member alters the rotational axis of the displaceable flywheel with respect to the body member.

11. The method for forming a toy car as set forth in claim 10, wherein the displaceable flywheel is formed to be removable from the body member, such that the displaceable flywheel may be replaced with another displaceable flywheel.

12. The method for forming a toy car as set forth in 11, further comprising an act of forming the body member to comprise at least one set of notches formed opposite to one another in the two side portions, wherein the body member is further formed such that the set of notches are approximately aligned with the rotational axis of the displaceable flywheel.

13. The method for forming a toy car as set forth in claim 12, further comprising an act of positioning the axle in the set of notches.

14. The method for forming a toy car as set forth in claim 13, further comprising an act of forming a detachably attachable extension element for detachable attachment with each axle cap.

15. The method for forming a toy car as set forth in claim 14, wherein the top portion is formed to be connectable with the bottom portion, and wherein the displaceable flywheel is positionable between the top portion and the bottom portion.

16. The method for forming a toy car as set forth in claim 15, wherein a central axis extends from the front portion to the rear portion, and wherein the displaceable flywheel is repositionable within the body member at different angles, such that repositioning the displaceable flywheel alters an angle between the central axis and the rotational axis of the displaceable flywheel.

* * * * *